United States Patent [19]

Frommholz et al.

[11] 3,955,905

[45] May 11, 1976

[54] SLIDING-VANE PUMP

[75] Inventors: Wilfried Frommholz; Wolfgang Scheidel, both of Buhl; Heinz Rübig, Buhlertal, all of Germany

[73] Assignee: Robert Bosch G.m.b.H., Stuttgart, Germany

[22] Filed: July 2, 1974

[21] Appl. No.: 485,307

[30] Foreign Application Priority Data

July 17, 1973 Germany ..... 2336307

[52] U.S. Cl. ..... 418/182; 64/1 V; 64/27 NM; 415/122 R; 403/225; 403/357

[51] Int. Cl.[2] ..... F01C 17/06

[58] Field of Search ..... 417/423 R, 312, 359, 417/363; 415/122, 140; 418/199, 108, 181, 182; 403/225, 226, 357; 64/1 V, 27 NM, 11 R

[56] References Cited

UNITED STATES PATENTS

| | | | |
|---|---|---|---|
| 1,940,886 | 12/1933 | Rosenberg | 403/225 |
| 2,724,770 | 11/1955 | Onksen, Jr. | 403/225 |
| 2,994,213 | 8/1961 | Arnold et al. | 64/27 NM |
| 3,059,583 | 10/1962 | Huber | 418/181 |
| 3,113,527 | 12/1963 | Kramer | 418/182 |
| 3,165,065 | 1/1965 | Stickel | 418/182 |
| 3,282,222 | 11/1966 | Raufeisen et al. | 417/410 |
| 3,360,193 | 12/1967 | Harris et al. | 417/312 |
| 3,433,166 | 3/1969 | Birkmeier | 418/182 |
| 3,459,275 | 8/1969 | Prillwitz et al. | 418/181 |
| 3,468,260 | 9/1969 | Belden | 417/410 |
| 3,477,794 | 11/1969 | Abbott et al. | 64/27 NM |

*Primary Examiner*—C. J. Husar
*Attorney, Agent, or Firm*—Michael J. Striker

[57] ABSTRACT

A pump housing accommodates in it an output shaft of an electromotor which forms a unit with the pump, and a rotor having substantially slots is mounted on the output shaft for rotation. The slots accommodate sliding vanes. A mounting member mounts the rotor on the output shaft in such a manner that the motor can tilt to a limited extent about two axes which are normal to each other and to the longitudinal axis of the output shaft of the electromotor.

8 Claims, 4 Drawing Figures

SLIDING-VANE PUMP

BACKGROUND OF THE INVENTION

The present invention relates generally to pumps, and more particularly to sliding-vane pumps.

It is known to provide sliding-vane pumps of the type wherein the actual pump forms a unit with the electromotor which drives it. In such constructions the housing of the pump has the output shaft of the electromotor extending into it in cantilever fashion, and the rotor of the pump is mounted on the output shaft for rotation therewith. The connection between shaft and rotor is by means of a key or the like. Such pumps can be of very compact construction, which is an advantage, as are certain other features of pumps of this type. However, this type of construction also has a significant disadvantage, namely the necessity of manufacturing all parts to very high tolerances. The effectiveness of a sliding-vane pump is primarily governed by the gap which develops between the outer rotor surface and the inner surface bounding the rotor cavity. The smaller this gap, the better will be the effectiveness of the pump. From this it follows that in order to maintain the gap as small as possible, very precise manufacturing tolerances must be maintained in the manufacture and assembly of the various components, and in particular with respect to the mounting of the rotor in the housing. This is particularly difficult to achieve when the rotor is mounted directly on the shaft of the electromotor, as in the particular type of construction here under discussion.

SUMMARY OF THE INVENTION

Accordingly, it is a general object of the present invention to overcome the disadvantages of the prior art.

More particularly, it is an object of the invention to provide a sliding-vane pump of the type wherein the driving electromotor and the pump itself form a unit, and wherein the output shaft of the electromotor extends into the pump housing, which pump is not possessed of the aforementioned disadvantages.

Another object of the invention is to provide a pump of the type under discussion which can be produced at lesser expense than previously, but wherein nevertheless any manufacturing tolerance variations, or variations resulting from the connection of the pump housing with the housing of the electromotor, will not disadvantageously influence the operation of the pump.

In keeping with these objects and with others which will become apparent hereafter, one feature of the invention resides in a sliding-vane pump, which, briefly stated, comprises a pump housing, an electromotor having an output shaft extending into the pump housing, and a rotor mounted on the output shaft for rotation therewith and having a plurality of substantially radial slots. A sliding vane is accommodated in each of these slots. Mounting means mounts the rotor on the output shaft with limited freedom of tilting movement relative to the output shaft about two axes which are normal to each other and to the output shaft.

With such a construction the play between the axial end faces of the rotor and the juxtaposed end faces of the housing can be maintained very small, but despite this there is no need to take into account any deviations of the axis of the electromotor output shaft from the central axis of the housing. It is particularly advantageous if at least one of the vanes is always located between the suction side and the pressure side of the pump.

We have found it to be of particular advantage if the mounting means utilizes a mounting nody having essentially quadratic form and having quadratic end faces which extend normal to the axis of rotation of the electromotor output shaft, and a first pair of diametrally opposite side faces which are convexly curved in outward direction and cylindrical in configuration and a second such pair which are also diametrically opposite but circumferentially offset with reference to the first pair and also convexly curved and cylindrical in configuration. Each pair has an axis of curvature and the two axes of curvature extend normal to one another and to the axis of rotation of the output shaft of the electromotor. The mounting body is of course connected with the output shaft in such a manner that it rotates with but cannot rotate relative to the same, and it is advantageously received in a central bore of the rotor, having a quadratic cross-section. The mounting body should advantageously contact the inner surface bounding this bore, only in line contact.

The novel features which are considered as characteristic are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
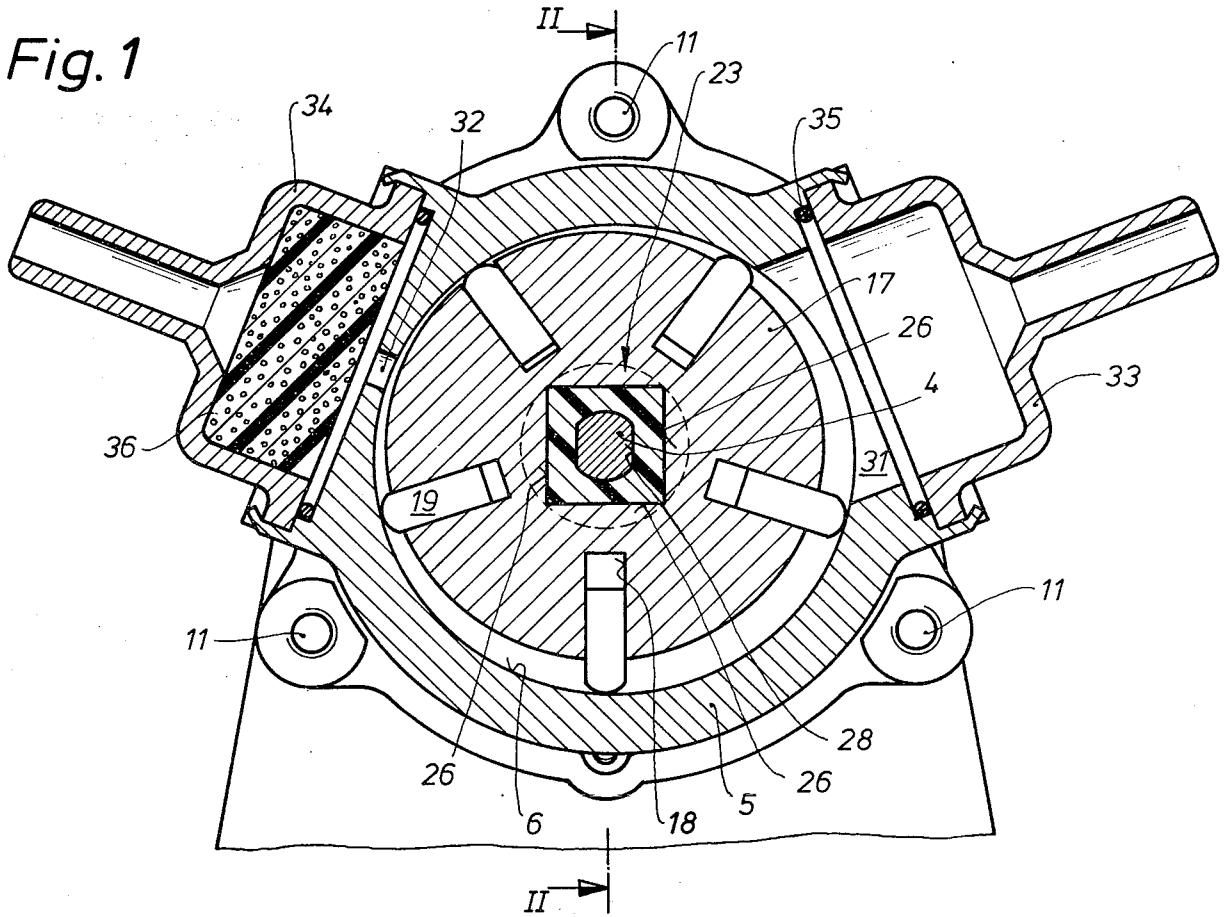
FIG. 1 is a cross-sectional view illustrating an embodiment of the invention.
Figure 2:
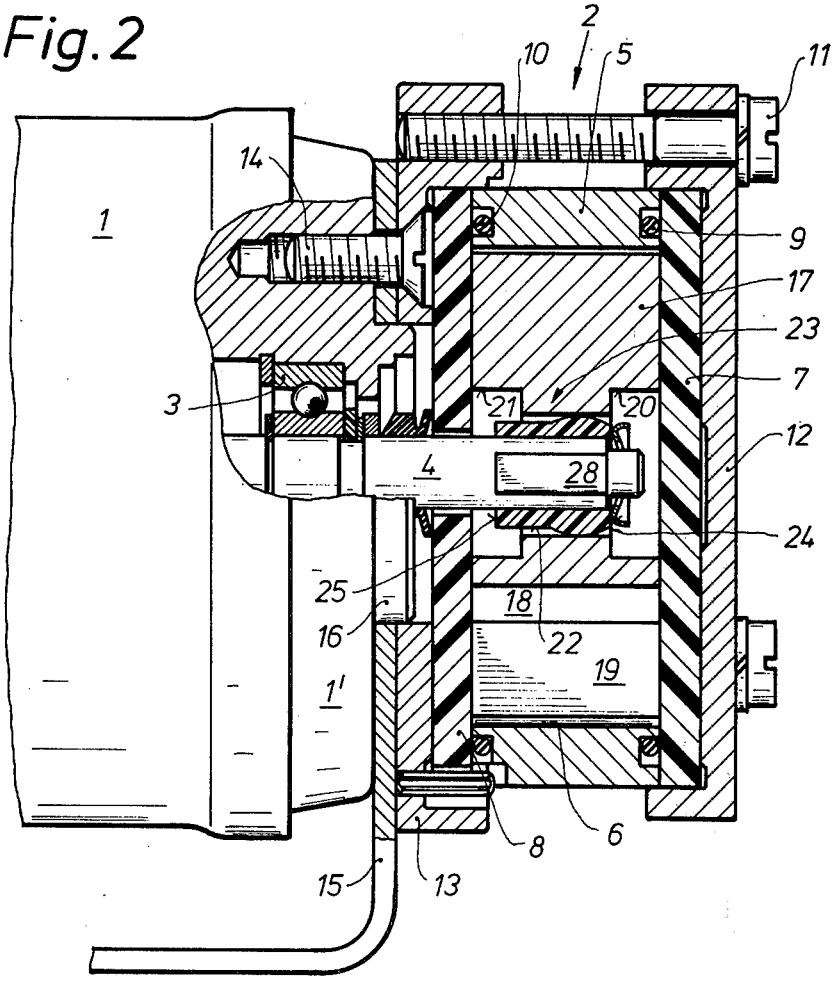
FIG. 2 is a longitudinal section through the embodiment of FIG. 1, taken on line II — II of FIG. 1.

Referring now to the drawing in detail, wherein FIGS. 1 – 4 show a single exemplary embodiment of the invention, it will be seen that reference numeral 1 identifies an electromotor which has not been shown in detail since it is entirely conventional and known per se. The electromotor 1 has an output shaft 4 extending into the interior of the housing of a sliding-vane pump 2 which is mounted on the housing of the electromotor 1. Reference numeral 3 identifies a bearing in which the shaft 4 is journalled and the electromotor will be assumed, for purposes of this description, to be a DC permanent magnet motor, although any other type of electromotor could be used.

The pump 2 has a substantially cylindrical control ring 5 which is arranged eccentrically with reference to the shaft 4 and surrounds a cylindrical chamber 6. At the opposite axial ends the chamber 6 is closed by a pair of end covers 7 and 8. O-rings 9 and 10 are partially received in grooves formed in the ring 5, and engage the end covers 7 and 8 to provide a seal with the same. The ring 5 may be an aluminum casting or a zinc casting, and its inner surface may be anodized or chromed.

It is advantageous to construct the end covers 7 and 8 of a material having a low coefficient of friction, for instance of the type known in certain branches of the industry as "synthetic coal". This is a material that is produced by mixing particles of carbonaceous material with cokeable binder, e.g. pitch, tar or a synthetic resin, and compressing the mixture to desired shape. The thus obtained body is then heat-treated at about 1300°C until binder and particles fuse together. The material is also known as manufactured carbon compound or synthetic carbon. These end covers 7 and 8 are held in their position by means of flange plates 12 and 13 which are connected with one another by cylinder head screws 11 that pull them towards one another in axial direction and thus press the flange plates 12 and 13 against the end covers 7 and 8, respectively, and the latter against the O-rings 9 and 10. The flange plate 13 which is closest to the electromotor 1 is connected to the housing of the latter by means of a plurality (only one shown) of countersunk screws 14; it has a retaining foot 15 which is pushed over a centering projection 16 on the end cover 1' of the housing of the electromotor 1.

A rotor 17 is accommodated in the chamber 6 of the pump and is provided with a plurality (here five) of substantially radially extending slots 18, each of which accommodates a vane 19 in tight, sliding relationship. The use of sliding vanes in such pumps is well known, as is the fact that the outer edges of the vanes 19 contact the cylindrical inner surface bounding the housing chamber 6, thus subdividing the working space into a plurality of individual cells. At least one vane 19 will always be located between the suction side and the pressure side of the working space.

Figure 3:
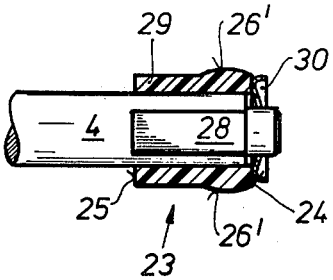
FIG. 3 is a fragmentary axial section, illustrating a detail of FIG. 2.
Figure 4:
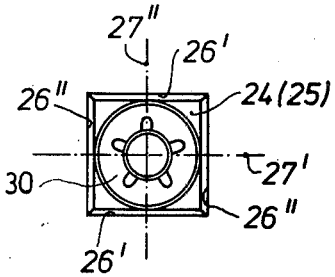
FIG. 4 is an end view of FIG. 3 looking towards the left.

At the opposite axial ends the rotor 17 is formed with a pair of concentric depressions 20, 21, and a concentric bore 22 of quadratic cross-section communicates with the bottoms of these depressions 20, 21. The bore 22 is so arranged that the intersection of diagonals extending between diagonally opposite corners of its quadratic cross-section, will be located on the axis of rotation of the rotor 17. The output shaft 4 of the electromotor 1 extends through the bore 22 into the depression 20 which faces away from the electromotor 1. A mounting body 23 is mounted on the shaft 4 and connects the rotor 17 with the shaft 4 for rotation with the same. In the illustrated embodiment, the mounting body 23 is of quadratic configuration and has two axial end faces 24 and 25 which extend normal to the axis of rotation of the rotor 17 which means normal to the longitudinal axis of the output shaft 4. It further has side faces 26, subdivided into a pair of side faces 26' which are located diametrally opposite one another and a circumferentially offset pair of side faces 26' which are also located opposite one another. As FIGS. 3 and 4 show, the side faces are cylindrical and convexly curved in outward direction, over at least part of their distance between the end faces 24 and 25. The two side faces 26' have a common axis of curvature 27', and the two side faces 26'' similarly have a common axis of curvature 27''; the two axes 27' and 27'' extend normal to one another, that is they intersect one another within the longitudinal axis of rotation of the output shaft 4. Thus, the axes of curvature 27', 27'' extend mutually normal to one another and also normal to the axis of rotation of the output shaft 4.

The output shaft 4 is provided with a pair of diametrically oppositely located facets 28, and the mounting body 23 has a central passage which is of matingly configurated interior cross section, being seated on the output shaft 4. The body has a cylindrical extension 29, as seen most clearly in FIG. 3. At the forward end of the output shaft 4 there is mounted a retaining ring 30 (which may be a toothed washer, as shown, a circlip or the like) which maintains the body 23 against displacement axially of the output shaft 4. The body 23 is of an elastomeric material, that is natural or synthetic rubber, or synthetic plastic material, for example, nylon or the trademarked material "Delvin". It is accommodated with as little play as possible in the bore 23 of the rotor 17, preferably even with a slight pre-stress. The surfaces of the body 23 contact the inner surface bounding the bore 22 only in line contact via the respective side faces 26', 26''.

The working space in the chamber 6 has a suction side and a pressure side. The suction side is connected via an inlet slot 31 with a nipple 33 which is a separate element and is connected with the ring 5 by upsetting of material in a recess provided for this purpose in the exterior of the ring 5. Similarly, a nipple 34 is mounted on the ring 5 in the same manner and communicates with the outlet slot 32. The juncture between the respective nipples 33, 34 and the ring 5 is sealed by means of O-rings 35. To reduce noise, a plug 36 of synthetic plastic foam material is accommodated in the nipple 35 which communicates with the outlet slot 34 at the pressure side of the pump. A separate outlet valve is not required in the illustrated embodiment but could be utilized, or could be provided in a modified embodiment within the concept of the invention. Of course, fluid can pass through the material of plug 36.

It will be appreciated that when the electromotor 1 is energized and the shaft turns, the rotor 17 will similarly rotate, and the vanes 19 will move with their radially outer edges along the inner cylindrical surface of the chamber 6. In so doing, the cells which are defined between two circumferentially successive ones of the vanes 19, become enlarged and draw in the medium to be pumped through the slot 31, and during further rotation each cell then becomes decreased and ejects the medium accommodated in it via the outlet slot 32. This is, of course, the conventional operation of sliding-vane pumps.

Unlike prior-art sliding-vane pumps, however, the position of the mounting member 23 according to the present invention makes it possible for the rotor 17 to tilt to a limited but adequate extent about the two mutually normal axes 27', 27'', thus permitting the rotor 17 to freely adjust itself within the chamber 6. Thus, the play of the rotor 17 in axial direction intermediate the end covers 7 and 8 can be maintained at a minimu, without having to take into account the deviation of the output shaft 4 from true and/or the deviation of the central axis of the chamber 6 from true or the combination of the two deviations.

When the radial play of the rotor circumference and the inner wall bounding the chamber 6 is taken into account, however, the deviation from true between the central axis of the chamber 6 on the one hand, and the shaft 4 on the other hand must be taken into account. However, any return flow of fluid from the pressure side to the suction side is avoided because — due to the use of five vanes 19 in the illustrated embodiment — it is assured that there will always be at least one of the vanes 19 located between the suction side 31 and the pressure side 32 of the pump. The construction can be further simplified if the flange plate 13, the foot 15 and the end cover 1' of the housing of the electromotor 1 are constituted as a single unitary element.

It will be understood that each of the elements described above, or two or more together, may also find a useful application in other types of constructions, differing from the types described above.

While the invention has been illustrated and described as embodied in a sliding-vane pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters patent is set forth in the appended claims.

1. A sliding-vane pump, comprising a pump housing; an electromotor having an output shaft extending into said pump housing; a rotor mounted on said output shaft for rotation therewith and having a plurality of substantially radial slots; a sliding vane in each of said slots; and mounting means mounting said rotor on said output shaft with limited freedom of tilting movement relative to said output shaft about two axes which are normal to each other and to said output shaft, said mounting means comprising a body of substantially quadratic outline having a pair of end faces extending normal to the axis of said shaft, a pair of concave first side faces diametrically opposite one another and having a common first axis of curvature, and a pair of convex second side faces diametrically opposite one another and having a common second axis of curvature, said axes of curvature constituting said two axes.

2. A pump as defined in claim 1, wherein said body is of elastomeric material, and is received in said bore under slight stress.

3. A pump as defined in claim 1, said rotor having a central bore of quadratic cross-section, and said body being received in said bore and having only line contact between said side faces and the inner surface bounding said bore.

4. A pump as defined in claim 1, said housing including a control ring having two axially spaced open ends, a pair of end plates each overlying one of said open ends, and flange plates engaging said end plates and being connected with one another for retaining said end plates in position.

5. A pump as defined in claim 4, one of said flange plates being closer to said electromotor than the other flange plate, and being threadedly connected to said electromotor.

6. A pump as defined in claim 4, said control ring having an inlet slot and an outlet slot, and a pair of nipples mounted on said control ring, each in communication with one of said slots.

7. A pump as defined in claim 4, wherein said end plates are of a material having a low coefficient of friction.

8. A pump as defined in claim 4, wherein said control ring has an inlet slot and an outlet slot, a nipple secured over and in communication with each of said slots, and a sound muffler in form of a foam-plastic plug associated with at least one of said nipples.

* * * * *